US010354468B2

(12) United States Patent
Paye

(10) Patent No.: US 10,354,468 B2
(45) Date of Patent: Jul. 16, 2019

(54) LOCKABLE RECEPTACLE HAVING PLURAL SECURITY FEATURES

(71) Applicant: Aminata Paye, Oklahoma City, OK (US)

(72) Inventor: Aminata Paye, Oklahoma City, OK (US)

( * ) Notice: Subject to any disclaimer, the term of this patent is extended or adjusted under 35 U.S.C. 154(b) by 0 days.

(21) Appl. No.: 15/687,934

(22) Filed: Aug. 28, 2017

(65) Prior Publication Data

US 2018/0061165 A1 Mar. 1, 2018

Related U.S. Application Data

(60) Provisional application No. 62/380,638, filed on Aug. 29, 2016.

(51) Int. Cl.

| | |
|---|---|
| ***G07C 9/00*** | (2006.01) |
| ***E05B 65/00*** | (2006.01) |
| ***E05G 1/10*** | (2006.01) |
| ***E05G 1/04*** | (2006.01) |
| ***E05G 1/06*** | (2006.01) |
| *E05B 35/00* | (2006.01) |

(52) U.S. Cl.

CPC ..... *G07C 9/00912* (2013.01); *E05B 65/0075* (2013.01); *E05G 1/04* (2013.01); *E05G 1/06* (2013.01); *E05G 1/10* (2013.01); *G07C 9/00039* (2013.01); *G07C 9/0069* (2013.01); *G07C 9/00079* (2013.01); *G07C 9/00111* (2013.01); *G07C 9/00174* (2013.01); *G07C 9/00309* (2013.01); *G07C 9/00563* (2013.01); *E05B 2035/009* (2013.01); *G07C 2009/00317* (2013.01); *G07C 2009/00769* (2013.01)

(58) Field of Classification Search

CPC ..... G07C 9/00912; G07C 9/00039; G07C 9/00111; E05B 65/0075

USPC ..... 340/5.7–5.74

See application file for complete search history.

(56) References Cited

U.S. PATENT DOCUMENTS

| | | | | |
|---|---|---|---|---|
| 8,369,595 | B1 * | 2/2013 | Derakhshani | G06K 9/0061 382/128 |
| 9,145,728 | B1 * | 9/2015 | LeBlanc | E05G 1/024 |
| 2015/0322694 | A1 * | 11/2015 | Carr | G07C 9/00896 70/277 |
| 2015/0332528 | A1 * | 11/2015 | McGinnis | E05B 65/0075 109/38 |
| 2016/0005284 | A1 * | 1/2016 | Batra | G08B 25/10 340/572.1 |
| 2016/0083978 | A1 * | 3/2016 | Dayanikli | E05B 47/0012 70/85 |
| 2016/0189502 | A1 * | 6/2016 | Johnson | G07C 9/00571 348/155 |
| 2016/0300209 | A1 * | 10/2016 | Schreckenberg | G07D 11/0009 |

(Continued)

FOREIGN PATENT DOCUMENTS

CN 2017-70451 S * 10/2017

*Primary Examiner* — Allen T Cao

(74) *Attorney, Agent, or Firm* — The Iwashko Law Firm, PLLC; Lev Ivan Gabriel Iwashko

(57) ABSTRACT

A lockable receptacle, including a housing having five walls and an opening, a first door disposed on the housing to close the opening of the housing, a locking mechanism to lock the first door, and a camera connected to the locking mechanism to unlock the locking mechanism in response to an authorized user being recognized by the camera.

8 Claims, 5 Drawing Sheets

(56) References Cited

U.S. PATENT DOCUMENTS

| | | | | |
|---|---|---|---|---|
| 2016/0374494 | A1* | 12/2016 | Geng | A47G 29/141<br>232/17 |
| 2017/0076520 | A1* | 3/2017 | Ho | G07C 9/00079 |
| 2017/0088099 | A1* | 3/2017 | Ma | G07C 9/00309 |
| 2017/0228603 | A1* | 8/2017 | Johnson | G06K 9/00771 |
| 2017/0256111 | A1* | 9/2017 | Chung | G07C 9/00309 |
| 2018/0108192 | A1* | 4/2018 | Ho | G06K 9/00288 |
| 2018/0108196 | A1* | 4/2018 | Abner | G07C 9/00174 |
| 2018/0165417 | A1* | 6/2018 | Hall | G16H 40/63 |

* cited by examiner

LOCKABLE RECEPTACLE HAVING PLURAL SECURITY FEATURES

CROSS-REFERENCE TO RELATED APPLICATIONS

This application claims priority under 35 USC § 120 from U.S. Provisional Application No. 62/380,638, filed on Aug. 29, 2016, in the United Stated Patent and Trademark Office, the disclosure of which is incorporated herein in its entirety by reference.

BACKGROUND OF THE INVENTION

1. Field

The present general inventive concept relates generally to lockable receptacles and, more particularly, to a lockable receptacle that employs a plurality of complementary security features.

2. Description of the Prior Art

The use of conventional lockable receptacles, such as safes, that employ a varying locking mechanisms is well known. A problem which still exists, however, is that such receptacles often only employ a single, direct access lock actuator, such as a padlock, a combination lock, or a biometric lock. Thus, there remains a need for a lockable receptacle having plural security features that allow it to secure its contents and maintain a record of all activity in its vicinity. It would be helpful if such a lockable receptacle having plural security features employed a plurality of layers of locking mechanisms. It would be additionally desirable for such a lockable receptacle having plural security features to include a wireless networking component to enable real time communication with preselected a mobile communication device as part of the unlocking sequence.

The present general inventive concept described herein provides tor a lockable receptacle adapted to maintain a high level of security through combinations of security features. The primary components in Applicant's a lockable receptacle having plural security features are a receptacle housing, a monitoring system, a locking door levels, and at least one storage drawer. When in operation, a lockable receptacle having plural security features facilitates more effective securing of valued items. As a result, many of the limitations imposed by prior art structures are removed.

SUMMARY

The present general inventive concept provides a lockable receptacle that employs a plurality of complementary security features.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a lockable receptacle, including a housing having five walls and an opening, a first door disposed on the housing to close the opening of the housing, a locking mechanism to lock the first door, and a camera connected to the locking mechanism to unlock the looking mechanism in response to an authorized user being recognized by the camera.

The lockable receptacle may further include an antenna to communicate with a mobile device having a mobile application running thereon, such that the mobile application stores information regarding authorized users to allow the authorized users to open the first door of the lockable receptacle.

The lockable receptacle may further Include at least one second door disposed behind the first door, the at least one second door comprising a biometric lock actuator connected to to least one of a retina scanner a fingerprint scanner to allow the biometric lock actuator to unlock in response to a detection of an authorized user.

The lockable receptacle may further include at least one third door disposed behind the second door, the at least one third door comprising a manually-implemented locking mechanism connected to at least one of a combination lock, a screen, and a keypad to unlock the manually-implemented locking mechanism in response to a correct code being entered.

The lockable receptacle may further include a plurality of storage drawers accessible by opening at least one of the at least one third door.

One third door may allow access to only a first storage drawer, and another third door may allow access to only a second storage drawer.

The lockable receptacle may further include an antenna to communicate with a mobile device having a mobile application running thereon, such that the mobile application stores information regarding authorized users and codes to allow the authorized users to open the first door, the at least one second door, and the at least one third door.

The lockable receptacle may further include at least one second door comprising a manually-implemented locking mechanism connected to at least one of a combination lock, a screen, and a keypad to unlock the manually-implemented locking mechanism in response to a correct code being entered.

The lockable receptacle may further include an identification tag including information related to the authorized user, the identification tag being communicable with and accessible to a mobile device.

The foregoing and/or other features and utilities of the present general inventive concept may also be achieved by providing a locking system, including a lockable receptacle comprising a series of doors to prevent unauthorized users from accessing contents within the lockable receptacle, and a mobile device to communicate with the lockable receptacle to provide information to the lockable receptacle regarding authorized users, to allow the authorized users to access the contents within the lockable receptacle.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE INVENTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present Other words used to describe the relationship between elements should be interpreted in a like fashion (e.g., "between" versus "directly between," "adjacent" versus "directly adjacent," etc.).

The terminology used herein is for the purpose of describing particular embodiments only and is not Intended to be limiting of example embodiments. As used herein, the singular forms "a," "an" and "the" are intended to include the plural forms as well, unless the context clearly indicates otherwise. It will be further understood that the terms "comprises." "comprising" "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong, it will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
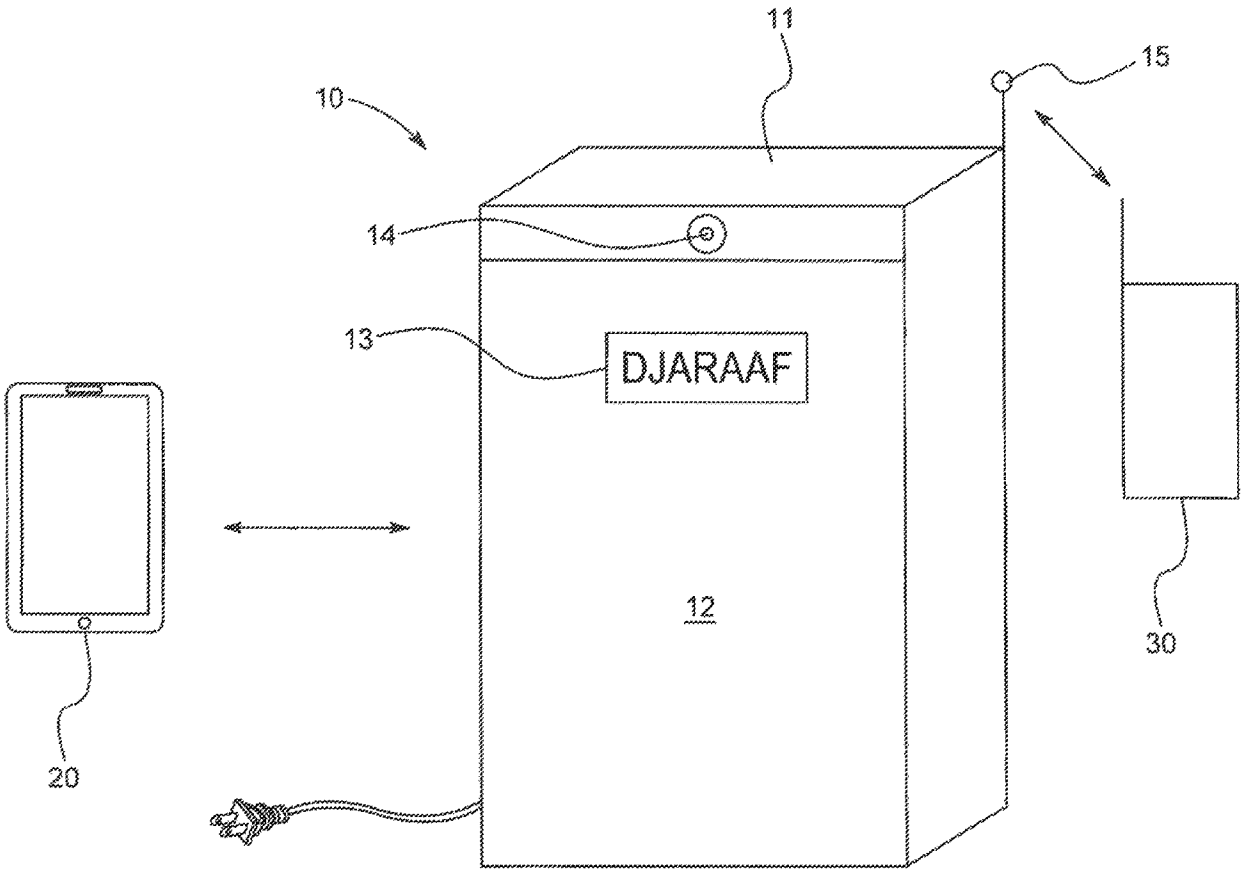
FIG. 1 is a front perspective view of the exterior of a lockable receptacle having plural security features, according to an exemplary embodiment of the present general inventive concept.
Figure 2:
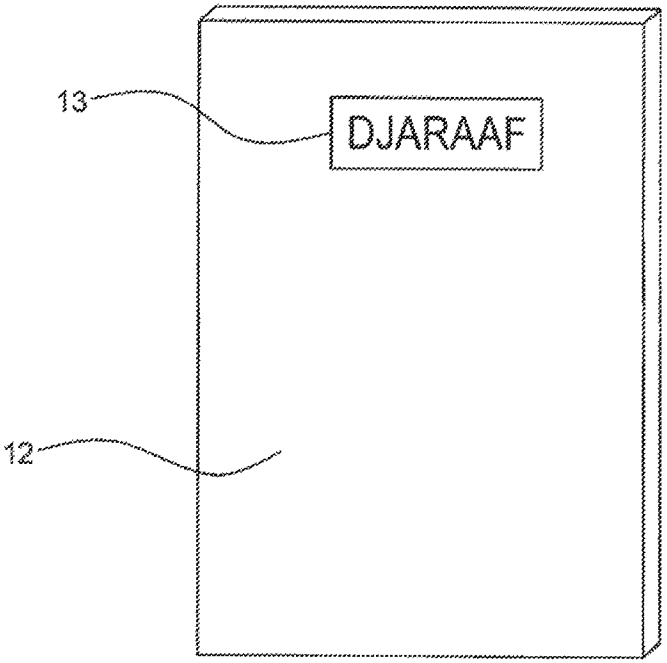
FIG. 2 is a front perspective view of the first level door of a lockable receptacle having plural security features, according to an exemplary embodiment of the present general inventive concept.

Referring now to the drawings and in particular FIGS. 1 and 2, a lockable receptacle 10 having plural security features is shown as a receptacle housing 11 with an exterior having a first door 12, an identification tag 13, a monitoring camera 14, and a networking antenna 15. The first door 12 includes a locking mechanism which is controlled by facial recognition system that is integrated with the monitoring camera 14 and the networking antenna 15. In one embodiment, a user must activate the system on a mobile device 30 that has been previously paired with the lockable receptacle 10 in order to have their face scanned. If the scan matches the lace of the previously entered owner, the first door 12 is unlocked.

In one embodiment, the networking antenna 15 defines a Bluetooth antenna and a user activates the system, by photographing and transmitting an image of the identification tag 13 from the mobile device 30 to the lockable receptacle 10 over the Bluetooth connection. Although Bluetooth communication between the mobile device 30 and the lockable receptacle 10 is described here, other wireless communication between the mobile device 30 and the lockable receptacle 10 may be utilized (i.e., WIFI near field technology, etc.), such that a downloadable mobile application may be used to transmit information between the mobile device 30 and the lockable receptacle 10.

The identification tag 13 may include information related to a user. The information related to the user may include passwords, passcodes, retinal information, fingerprint information, and face recognition information.

The identification tag 13 may also be transferred to other lockable devices desired by the user, such as packages, luggage, etc., but is not limited thereto. The identification tag 13 may also be a static radio frequency tag that can communicate with the mobile device 30. As such, information included in the identification tag 13 may be accessed using the mobile device 30, so that the identification, tag 13 may also be trackable by the user using the mobile device 30.

Figure 3:
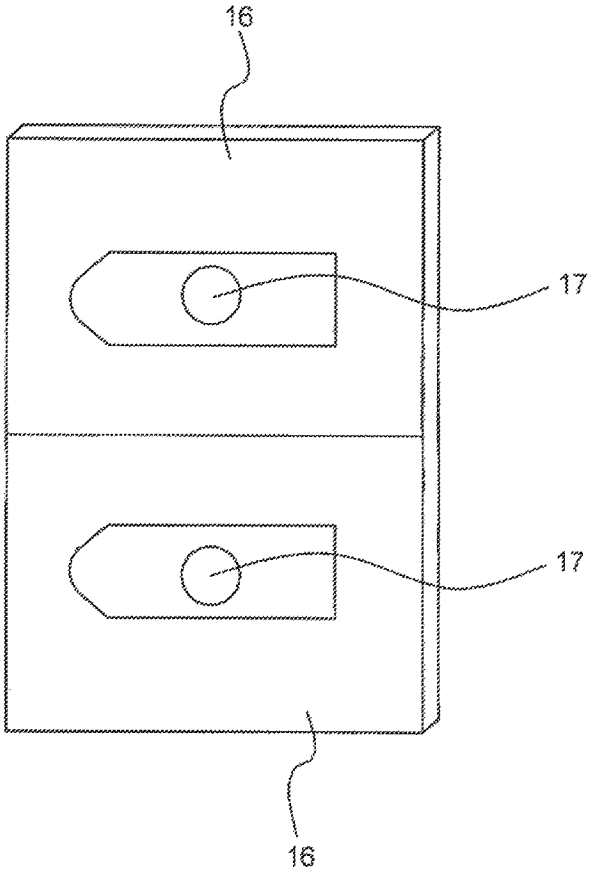
FIG. 3 is a front perspective view of the second level doors of a lockable receptacle having plural security features, according to an exemplary embodiment of the present general inventive concept.

Referring now to FIG. 3, in one embodiment a second door level is defined by two second level doors 16 which each can be accessed independently. It is contemplated each of the second level doors 16 include a biometric lock actuator 17, with one-employing a retina scanner and the other employing a fingerprint scanner.

Figure 4:
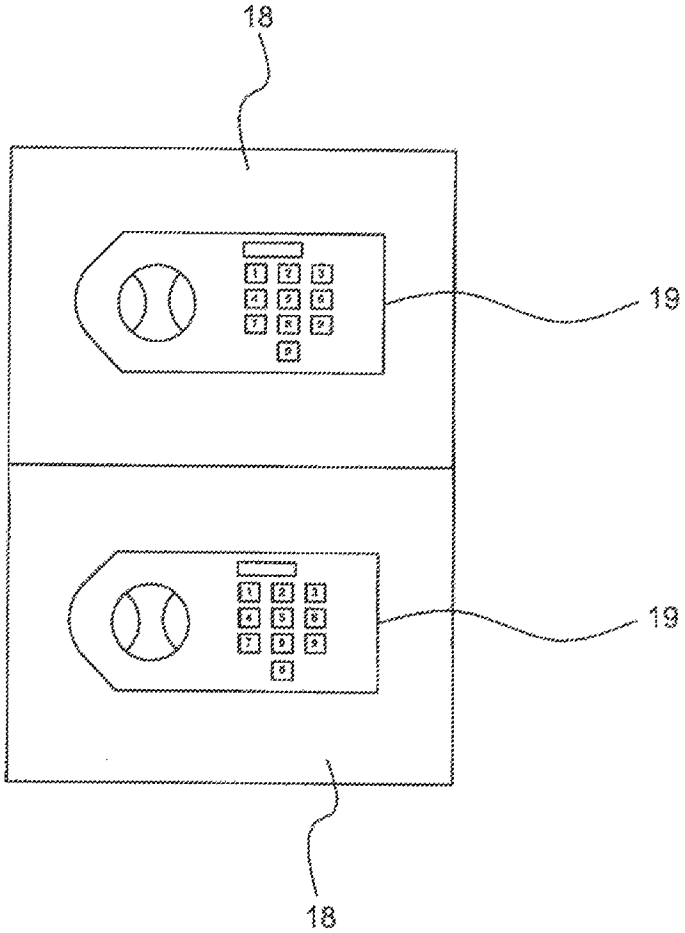
FIG. 4 is a front perspective view of the third level doors of a lockable receptacle having plural security features, according to an exemplary embodiment of the present general inventive concept.

Referring now to FIG. 4, in one embodiment a third door level is defined by two third level doors 18 which each can be accessed independently. It is contemplated each of the third level doors 18 include a digital screen and keypad mechanism 19 to enable the operation of a combination lock. In one embodiment, each of the third level doors 18 would require a different combination.

Although FIG. 4 describes the third level doors 18, the digital screen and keypad mechanism 19 of third level doors 18 may be implemented on the second level doors 16. Likewise, although FIG. 3 describes the second level doors 16, the biometric lock actuators of the second level door 16 may be implemented on the third level doors 18.

Figure 5:
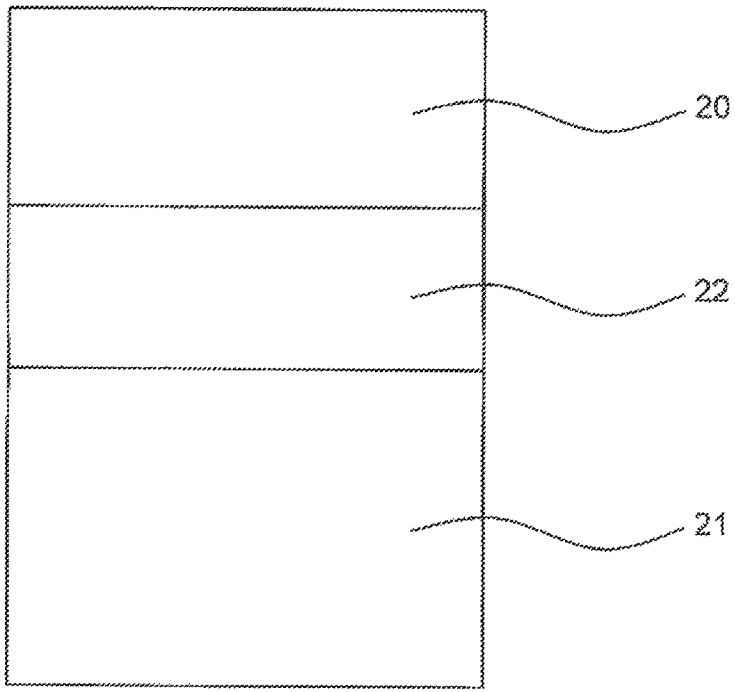
FIG. 5 is a front perspective view of the storage drawers of a lockable receptacle having plural security features, according to an exemplary embodiment of the present general inventive concept.

Referring now to FIG. 5, in one embodiment valued items can be stored in one of a plurality of storage drawers 20, 21, 22. It is contemplated that a top storage drawer 21 and bottom storage drawer 22 may be accessed with a user only having to open both of the top or bottom doors on the second and third levels, while access to the middle storage drawer 22 requires that every door on every level be opened. In this regard, it is contemplated that the middle storage drawer 22 may be used for an owners most valued items.

In one embodiment, all interactions which each door on the lockable receptacle 10 are recorded and logged and then transmitted to the paired mobile device 30 in real time (or immediately after the mobile device becomes in range of the lockable receptacle 10).

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A lockable receptacle, comprising:

a housing having five walls and an opening;

a first door disposed on the housing to close the opening of the housing;

a locking mechanism to lock the first door;

a camera connected to the locking mechanism to unlock the locking mechanism in response to an authorized user being recognized by the camera;

at least one second door disposed behind the first door, the at least one second door comprising a biometric lock actuator connected to at least one of a retina scanner and a fingerprint scanner to allow the biometric lock actuator to unlock in response to a detection of an authorized user; and at least one third door disposed behind the second door, the at least one third door comprising a manually-implemented locking mechanism connected to at least one of a combination lock, a screen, and a keypad to unlock the manually-implemented locking mechanism in response to a correct code being entered.

2. The lockable receptacle of claim 1, further comprising:

an antenna to communicate with a mobile device having a mobile application running thereon, such that the mobile application stores information regarding authorized users to allow the authorized users to open the first door of the lockable receptacle.

3. The lockable receptacle of claim 1, further comprising:

a plurality of storage drawers accessible by opening at least one of the at least one third door.

4. The lockable receptacle of claim 1, wherein one third door allows access to only a first storage drawer, and another third door allows access to only a second storage drawer.

5. The lockable receptacle of claim 1, further comprising:

an antenna to communicate with a mobile device having a mobile application running thereon, such that the mobile application stores information regarding authorized users and codes to allow the authorized users to open the first door, the at least one second door, and the at least one third door.

6. The lockable receptacle of claim 1, further comprising:

at least one second door comprising a manually-implemented locking mechanism connected to at least one of a combination lock, a screen, and a keypad to unlock the manually-implemented locking mechanism in response to a correct code being entered.

7. The lockable receptacle of claim 1, further comprising:

an identification tag including information related to the authorized user, the identification tag being communicable with and accessible to a mobile device.

8. A locking system, comprising:

a lockable receptacle comprising a series of doors to prevent unauthorized users from accessing contents within the lockable receptacle;

a mobile device to communicate with the lockable receptacle to provide information to the lockable receptacle regarding authorized users, to allow the authorized users to access the contents within the lockable receptacle;

at least one second door disposed behind the first door, the at least one second door comprising a biometric lock actuator connected to at least one of a retina scanner and a fingerprint scanner to allow the biometric lock actuator to unlock in response to a detection of an authorized user; and at least one third door disposed behind the second door, the at least one third door comprising a manually-implemented locking mechanism connected to at least one of a combination lock, a screen, and a keypad to unlock the manually-implemented locking mechanism in response to a correct code being entered.

* * * * *